US005301000A

United States Patent [19]

Heigl

[11] Patent Number: 5,301,000

[45] Date of Patent: Apr. 5, 1994

[54] FIXING STATION FOR AN ELECTROPHOTOGRAPHIC PRINTING OR COPYING APPARATUS

[75] Inventor: Karl Heigl, Buntspechtweg, Fed. Rep. of Germany

[73] Assignee: Siemens Nixdorf Informationssysteme Aktiengesellschaft, Fed. Rep. of Germany

[21] Appl. No.: 861,817

[22] PCT Filed: Nov. 27, 1990

[86] PCT No.: PCT/EP90/02027

§ 371 Date: Jun. 10, 1992

§ 102(e) Date: Jun. 10, 1992

[87] PCT Pub. No.: WO91/09351

PCT Pub. Date: Jun. 27, 1991

[30] Foreign Application Priority Data

Dec. 13, 1989 [EP] European Pat. Off. ..... 89123033.6

[51] Int. Cl.[5] ..... G03G 15/20

[52] U.S. Cl. ..... 355/290; 219/216

[58] Field of Search ..... 355/282, 285, 289, 290; 219/216, 469

[56] References Cited

U.S. PATENT DOCUMENTS

| | | | |
|---|---|---|---|
| 4,121,089 | 10/1978 | Bishop | 219/216 |
| 4,493,982 | 1/1985 | Romansky | 219/469 |
| 4,498,757 | 2/1985 | Lance et al. | 219/216 X |
| 4,736,226 | 4/1988 | Mogi | 355/290 |
| 4,839,694 | 6/1989 | Kawashima et al. | 355/285 X |
| 4,899,197 | 2/1990 | Davis et al. | 355/290 |

FOREIGN PATENT DOCUMENTS

| | | | |
|---|---|---|---|
| 0184202 | 6/1986 | European Pat. Off. . | |
| 3941193 | 7/1991 | Fed. Rep. of Germany | 355/289 |
| 57-176067 | 10/1982 | Japan . | |
| 0014868 | 1/1983 | Japan | 355/289 |
| 0149683 | 6/1988 | Japan | 355/289 |
| 1-136181 | 5/1989 | Japan . | |
| WO91/09351 | 6/1991 | PCT Int'l Appl. | 355/290 |

OTHER PUBLICATIONS

IBM Technical Disclosure Bulletin, vol. 32 No. 1 Jun. 1989, "Customer Serviceable Hot Roll".

IBM Technical Disclosure Bulletin, vol. 32 No. 1 Jun. 1989, "Inside-out Fuser Roll Drive".

*Primary Examiner*—A. T. Grimley

*Assistant Examiner*—Robert Beatty

*Attorney, Agent, or Firm*—Hill, Steadman & Simpson

[57] ABSTRACT

A fixing station of an electrophotographic printing or copying apparatus includes a fixing roller (11) heated via a radiator module (30) and a pressure roller swingable up to and away from the fixing roller (11) via a cam mechanism (8, 7). In order that the fixing roller and pressure roller can be exchanged in the hot state, the fixing roller (11) is mounted in bearing flanges (14, 16), one bearing flange (16) being fastened fixedly and the other bearing flange (14) releasably in the machine. The releasable bearing flange (14) has holding elements (26) for the fixing roller, as well as a handle, by which the bearing flange (14), together with the fixing roller (11) suspended on it, can be removed from the fixing station. The pressure roller (9) is mounted releasably between two rockers (8) via a releasable receiving bolt (57). A cooling sheer (40, 51) is arranged in the machine for receiving the heated fixing roller (11) and the radiator module (30).

17 Claims, 6 Drawing Sheets

FIXING STATION FOR AN ELECTROPHOTOGRAPHIC PRINTING OR COPYING APPARATUS

BACKGROUND OF THE INVENTION

It is customary, in electrophotographic printers or copiers, to fix the recording medium, coated with toner, in a thermal fixing station. Thermal fixing stations of this type generally contain electrically heated fixing rollers having associated swing-to and swing-away pressure rollers. For the fixing, the recording medium is guided through between the fixing rollers and pressure rollers. The toner on the recording medium is fixed by the action of heat from the fixing roller. Since the toner has to be brought to melting temperature in the course of the short zone of contact of the recording medium with the fixing roller, a high heating capacity is necessary for the fixing roller. It is conventional, for this purpose, to install halogen radiators of high heating capacity in the hollow fixing roller.

But the disadvantage of halogen radiators is that their burning time is relatively short and that it is therefore necessary to exchange them quite frequently.

U.S. Pat. No. 4,493,982 makes known a device for extracting radiant heaters from the fixing station of a copier, which makes it possible to extract the radiant heater even in the hot state. The fixing roller remains in the housing of the machine.

European reference 0,184,202 (corresponding to U.S. Pat. No. 4,736,226) describes a fixing device having a fixing roller which is mounted on heating bars as bearing elements. To exchange the fixing roller, the heating bars are drawn out of the machine housing. An exchange of the fixing roller in the hot state is possible only with difficulty and only by a maintenance technician.

It has hitherto been customary, in the event of damage, for the exchange of the defective radiant heater and the defective fixing roller to be carried out by a trained maintenance technician, with the machine cold. This leads to a long machine shutdown and high expenditure for the repair of the machine. A particular disadvantage has been that, before the actual exchange, it has been necessary to wait until both the fixing roller and the halogen radiator to be exchanged have cooled. In view of the high thermal capacity of the fixing roller, this can take a relatively long time.

Moreover, to exchange the radiant heaters, it has been necessary to dismount the entire heating roller, thus additionally complicating the exchange.

Since the recording medium is moved between the fixing roller and pressure roller by means of friction, the pressure roller is subjected to relatively high wear. To exchange the pressure roller, it has hitherto been conventional to dismantle the entire fixing station. This involves a high outlay and leads to lengthy undesirable idle times of the printing apparatus.

SUMMARY OF THE INVENTION

The object of the invention is to design a fixing station of the type mentioned in the introduction, in such a way that it is of easy-to-maintain design, so that wearing parts can be exchanged without a special tool.

In a device of the type mentioned in the introduction, this object is achieved by a fixing station for an electrophotographic printing or copying apparatus, having an electrically heated fixing roller and a pressure roller swingable up to and away from the fixing roller via a fastening mechanism, wherein the fixing roller is designed as a hollow roller having heating elements arranged therein and is mounted in a stand of the fixing station via bearing flanges. A first bearing flange is fixed to the stand and a second bearing flange is releasably attached to the stand. Holding elements are designed in such a way that, for the extraction of the fixing roller from the fixing station, they connect the second bearing flange to the fixing roller and allow a separation of the second bearing flange from the extracted fixing roller.

Advantageous embodiments of the invention are as follows.

The second bearing flange has a handle element. The bearing flanges have centering elements which engage laterally into the fixing roller and on which the fixing roller rests and can slide. Spring elements are arranged on at least one of the bearing flanges for compensating for thermal axial movement of the fixing roller which clamp the fixing roller between the bearing flanges. Heat-insulating elements are arranged in the fixing roller which screen off the bearing flanges relative to a region heated by the heating elements. The bearing flanges have central receiving orifices which are for the exchangeable reception of heating elements combined to form a radiator module and which are arranged in such away that the radiator module can be exchanged without removal of the fixing roller. The radiator module has at one end a reception region for receiving a thermally insulating gripping piece. The pressure roller is mounted releasably between two rockers swingable up to and away from the fixing roller about an axle via an electromotively driven eccentric device. The eccentric device has a camshaft with cam disks arranged thereon, the camshaft being variable via an adjusting mechanism in terms of its location relative to the rockers to be actuated. The pressure roller is mounted releasably via a fixed bolt and a bolt movable counter to a spring, the movable bolt having an operating knob. A cooling shelf for the fixing roller and/or the heating element can be provided.

According to the invention, both the fixing roller and the pressure roller can be exchanged without a special tool. The radiator module arranged in the fixing roller and intended for heating the fixing roller is likewise made exchangeable, and for the exchange of this part which is especially susceptible to wear the fixing roller can remain in the fixing station. So that the exchanged hot rollers or the radiator module can cool safely, the machine has a cooling shelf.

By means of the invention, the standstill times necessary for the maintenance of the machine are reduced suostantially. The exchange can be carried out by the machine operator himself, without specially trained maintenance technicians being needed.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, and in which:

DESCRIPTION OF THE PREFERRED EMBODIMENT

Figure 1:
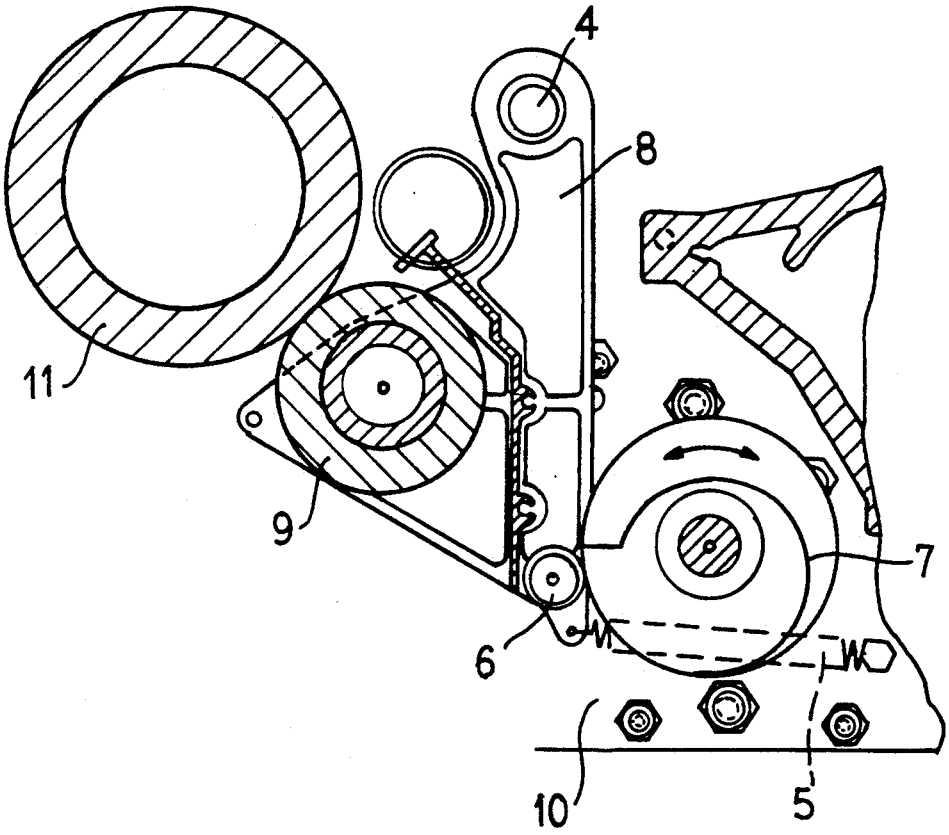
FIG. 1 shows a sectional representation of a fixing station in an electrophotographic printing apparatus.

A fixing station (FIG. 1) of an electrophotographic printing apparatus contains a fixing roller or heating roller 11, which is mounted on a stand 10 of the printing machine, and a pressure roller 9 consisting of a steel tube sheathed with rubber. The pressure roller 9 is mounted on two rockers 8 and can be swung up to and away from the fixing roller 11 via extensions 6 by means of two electromechanically driven cam disks 7 (arrow direction). For this, the rockers 8 are pivoted about the axle 4 counter to the force of springs 5. The heating roller 11 consists of an aluminum tube 13 which is coated with Teflon 12 and which is open on both sides. The heating roller 11 is mounted in the stand 1 0 of the fixing station, specifically, on one side, via a bearing flange 14 having a central holding and guiding orifice 15 and, on the other side, via a bearing element 16 which is connected to a drive device 17, shown only diagrammatically here, in the form of a bet pulley 18. Located on the bearing flange 14 is a bearing 19/1 which engages by means of a centering piece 20 into the aluminum tube 13 of the heating roller 11. The other bearing element 16, with a bearing 19/2, on the drive side of the fixing station likewise has a centering extension 21 which engages into the other side of the aluminum tube 13 of the heating roller 11. So that the heating roller 11 can be supported securely, there are arranged on the bearing element 16 cup springs 22 which grasp the heating roller via a disk 22/1 and which press ft against the centering piece 20 of the beaiing flange 14. They ensure the compensation of the axial thermal expansion. At the same time, the aluminum tube of the heating roller 11 slides on the centering extension 21, the disk 22/1 being connected to the centering extension 21 via screws 21/1. A driving part 23 on the bearing element 16 engages into a corresponding recess of the aluminum tube 13 of the heating roller 11 and thus ensures a reliable drive connection. The bearing flange 14 is connected releasably via thumb screws 24 to the stand 10 of the fixing station. The heating roller 11 is secured relative to the bearing flange 14 by means of holding claws 26 fastened via thumb screws 25. For this purpose, the holding claw 26 has an extension 27 which engages into a groove 28 of the heating roller, in the installed state the extension 27 not touching the groove 28, so that the heating roller 11 can move freely radially. The holding claw 26 has a securing function during the exchange of the fixing roller 11.

To exchange the fixing roller, the thumb screws 24 are loosened and the fixing roller 11, together with the flange 14, and secured by the holding claws 26, can be drawn out of the stand 10 of the fixing station by means of a handle 29 fastened to the bearing flange 14 and exchanged.

So that the fixing roller 11 is not damaged on its cylindrical surface, mounting 24/1 receiving the thumb screws 24 is covered on the inside with felt 24/2.

Arranged in the fixing roller 11 is a radiator module 30 consisting of a plurality of, for example two halogen radiators arranged one above the other. This radiator module is made exchangeable. For this purpose, it is guided on one side in the holding and guiding orifice 15 of the bearing flange 14 and on the other side in an angle 31 which serves as a spacer and which is fastened to the bearing element 16 of the drive side of the fixing station. The angle 31 has a passage orifice 32 which serves for the guidance and retention of the radiator module 30. So that the radiator module 30 can be exchanged even in the hot state, a gripping piece 33 made of heat-insulating plastic is arranged on the other end of the radiator module. This gripping piece has an extension 34 which centers the radiator module 30 in the passage orifice 32. The radiator module 30 can be fastened in the passage orifice 32 via the extension 34 by means of a clamping device in the form of a clamping screw 35.

For the reliable guidance of the radiator module consisting of glass, the radiator module possesses on one side a spacer (sleeve) 36 which consists of sheet metal and which holds the radiator module securely in the holding and fixing orifice 15 of the bearing flange 14. The sleeve 36 can also be an integral part of the bearing flange 14, or d can be pushed as an independent element over the radiator module before installation.

Further heat-insulating elements are funnels 37 which consist of sheet aluminum and have a central passage orifice for the radiator module and which are arranged on both sides in the aluminum tube 13 of the fixing roller 11. The funnels screen off the actual heat-generating region of the radiator module 30, together with the spiral-wound filaments arranged therein, relative to the bearings and thereby prevent an inadmissible overheating of the bearings 19/1, 19/2. Protective measures of this kind are necessary because the roller temperature on the outer surface of the fixing roller can amount to 215°-225° during the actual printing.

The radiator module 30 is contacted electrically via a plug 38, located in the region of the gripping piece, and a further plug 39 in the region of the bearing flange 14.

The radiator module 30 can now be exchanged in a simple way, even in the hot state, by the operator himself. For this purpose, first the plug 39 and then the thumb screws 24 are released, and the radiator module can then be drawn out of the fixing roller 11 by the grip 33 according to the representation of FIG. 3. The angle 31 serving as a spacer element ensures a reliable contact-free extraction.

Figure 2:
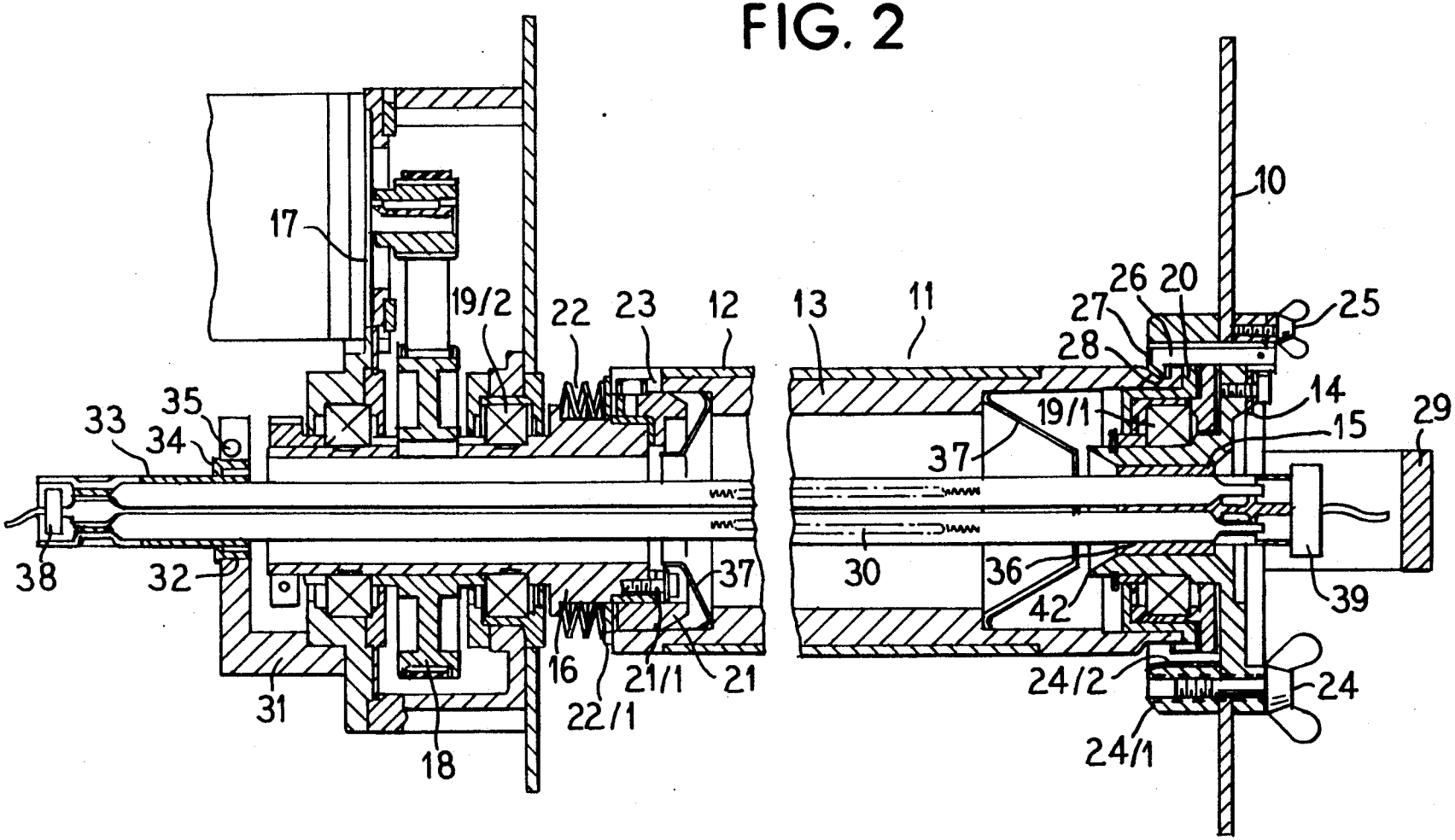
FIG. 2 shows a sectional representation of a heating roller in a fixing station of an electrophotographic printing apparatus having a radiator module arranged therein.
Figure 3:
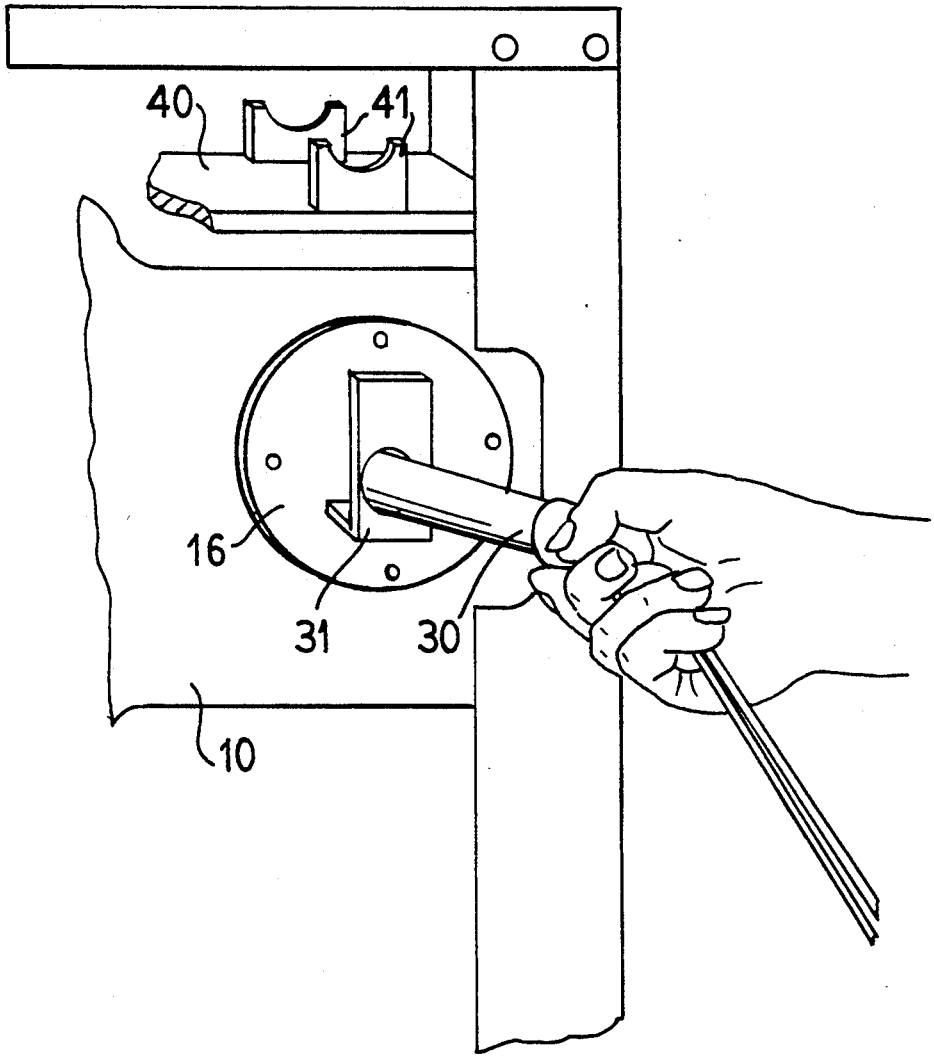
FIG. 3 shows a diagrammatic representation of an electrophotographic printing machine, with the front plate removed, during the exchange of the radiator module.

The printing apparatus additionally possesses, in a special region insensitive to heat, a holding device 40 having two supporting elements 41 which serve for receiving the radiator module during the cooling phase (FIG. 3). Before the radiator module has cooled sufficiently, a new radiator module can in the meantime be pushed into the fixing roller 11 and fixed by means of the clamping device 35. This pushing in is made easier by a centering extension 42 on the bearing flange 14 (FIG. 2). If the plug 39 of the electrical connection in the region of the bearing flange is to be fitted in a stationary manner, the centering effect of the holding and fixing orifice allows a reliable and damage-free contacting between the plug 39 and radiator module 30.

Figure 4:
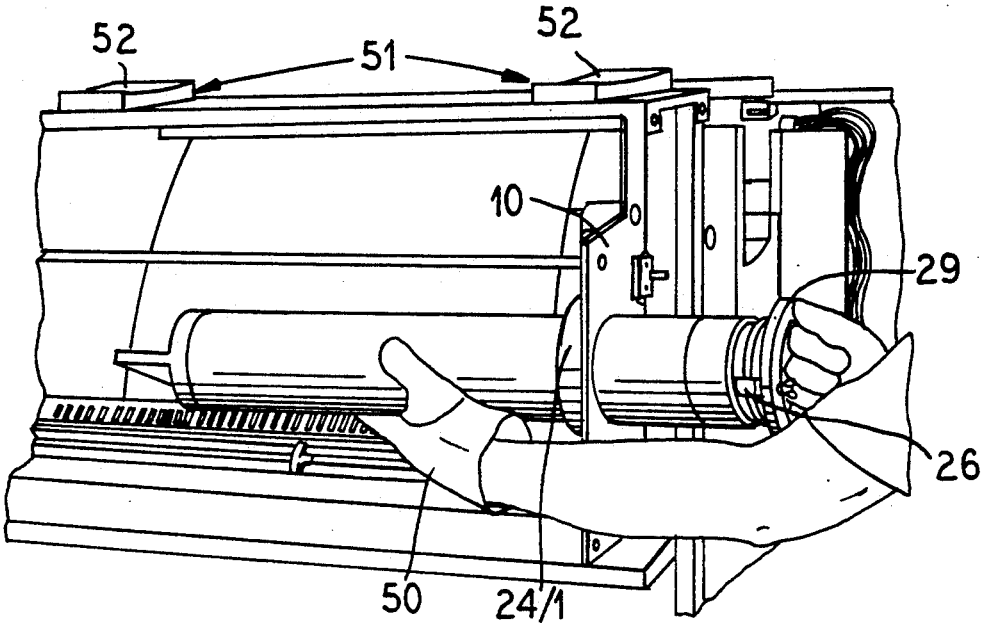
FIG. 4 shows a diagrammatic representation of an electrophotographic printing machine, with the front plate removed, during the exchange of the fixing roller.

As already described in the introduction, the heating or fixing roller 11 too can be exchanged in the hot state. For this, it is necessary for safety reasons to remove the radiator module 30 beforehand. Furthermore, the fixing station must be in an operating state in which the pressure roller 9 is swung away from the fixing roller 11. An oiling device, not shown here, on the fixing station likewise has to be swung away. The thumb screws 24 on the bearing flange 14 of the tending side are now loosened. According to the representation of FIG. 4, by means of protective gloves 50 the operator draws the roller from the drive flange 16 by the handle 29 and draws it out of the machine through the side plate 10. The fixing roller 11 is then deposited on a cooling sheer 51 arranged, for example, above the fixing station and having resting pedestals 52. The cooling sheer can be arranged anywhere on the machine or it is possible to arrange a separate cooling shelf on a separate stand in the vicinity of the machine.

A second bearing flange 14 made ready is inserted into a new fixing roller 11 and fastened to the latter by means of the holding claws 26. The bearing flange 14 together with the roller 11 are now inserted into the fixing station in the reverse order to that described previously. The exchange of the heating roller can be carried out by the operator without a tool.

The pressure roller 9 is also mounted exchangeably in the fixing station. This is described in more detail below with reference to FIGS. 5 to 8.

The pressure roller 9 consists of a steel tube 53 which is sheathed with 12 mm silicone rubber 54 and an approximately 1 mm thick PFA layer. The pressure roller is designed as a hollow roller and has a fixedly installed ball bearing 55 at each of the two ends. The pressure roller 9 is mounted between the two rockers 8, specifically, on one side (drive side), via a fixed bolt 56 and, on the tending side, via a movable receiving bolt 57. The movable receiving bolt 57 is mounted in a guide sleeve 58 so as to be axially displaceable counter to the force of a spring 59 and has an operating knob 60 in the form of a spherical head, by means of which the movable bolt 57 can be drawn out of the ball bearing 55. In addition, the receiving bolt 57 is connected to a pot-shaped casing 61 which is guided on the guide sleeve 58. The casing 61 has a collar-shaped extension 62 which interacts with a stop 63 of the fixing station. The collar-shaped extension 62 and stop 63 serve as a locking device. Only when the pressure roller 9 is swung away from the fixing roller 11 is the collar-shaped extension 62 located outside the effective range of the stop 63 and the movable receiving bolt 57 can be drawn back via the operating knob 60 and the pressure roller 9 thus released. If the pressure roller 9 is swung to, the stop 63 prevents a release of the connection between the movable receiving bolt 57 and pressure roller 9. Moreover, the locking stop 63 is also coupled to a roll carrier (paper guide) not shown here and arranged under the fixing station, specifically in such a way that the lock of the pressure roller 9 can be released only when this so-called roll carrier is opened. This is intended to prevent a jamming of the roll carrier or damage to the roll carrier.

The pressure roller is swung up to and away from the fixing roller 11 by means of a stepping motor 64 engaging via a claw coupling 65 on a camshaft 66, on which two cam disks 7 are fastened. At the same time, the camshaft 66 is mounted in the stand 10 of the machine via an adjusting mechanism 67 which serves for adjusting the pressure-spring force of the pressure roller. The cam disks 7 bear against pressure elements 6 of the rockers 8 under the effect of the springs 5. The rockers 8 are themselves pivotable about the axle 4 via bearings 68. To adjust the pressure-spring force, there are arranged (FIG. 7) on the adjusting mechanism 67 two adjusting screws 69, via which the position of the camshaft 66 can be varied or adjusted in terms of its location relative to the pressure roller 9.

So that the position of the camshaft and therefore the location of the pressure roller 9 can be sensed, a sensing device 70 in the form of a Hall generator is arranged on the camshaft 66. This sensing device supplies the corresponding shaft position in the form of sensing signals to the control arrangement of the printing apparatus or into a corresponding monitoring device for controlling the running of the paper.

Figure 8:
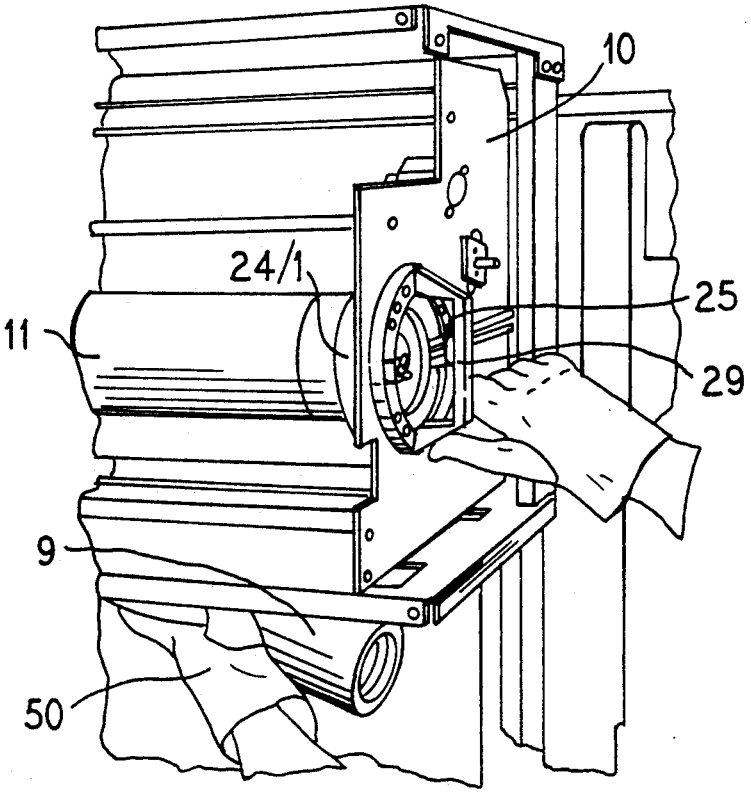
FIG. 8 shows a diagrammatic representation of the pressure-roller exchange.
Figure 5:
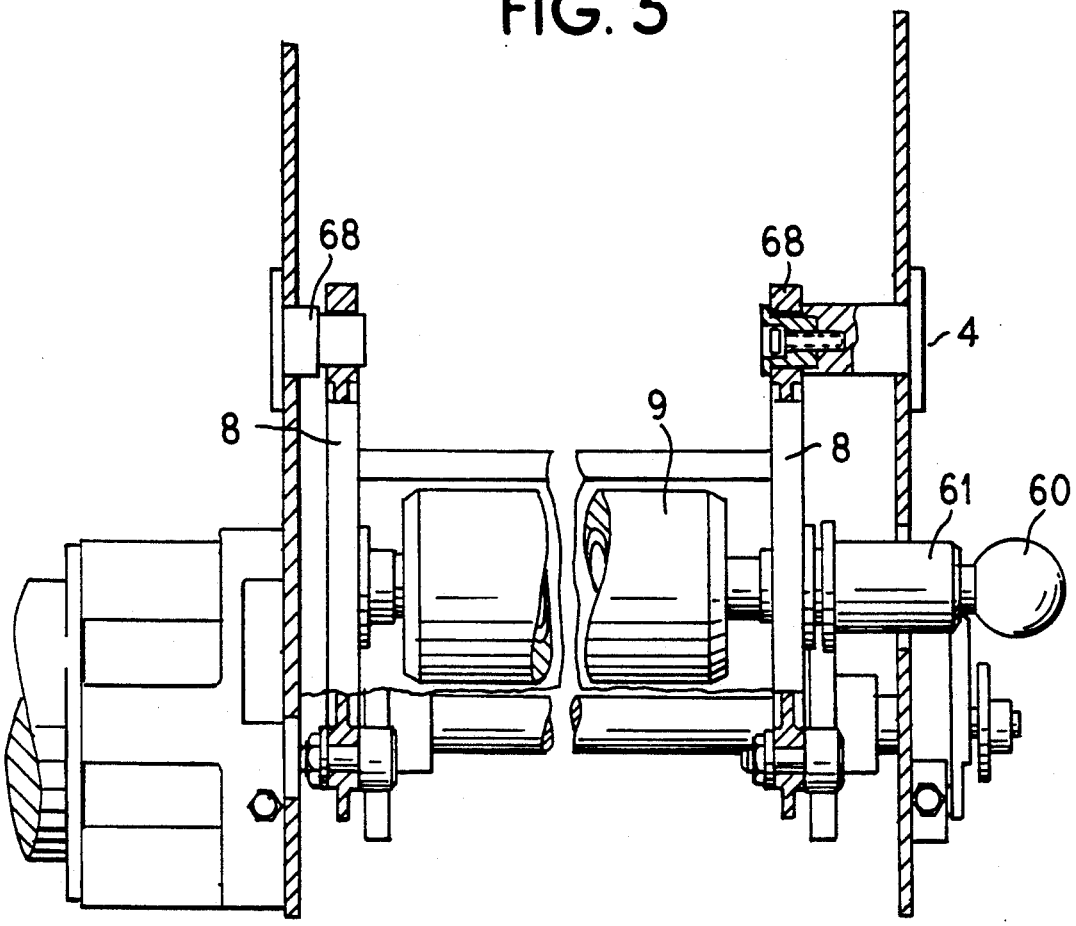
FIG. 5 shows a diagrammatic representation of the mounting of the pressure roller in a top view.
Figure 7:
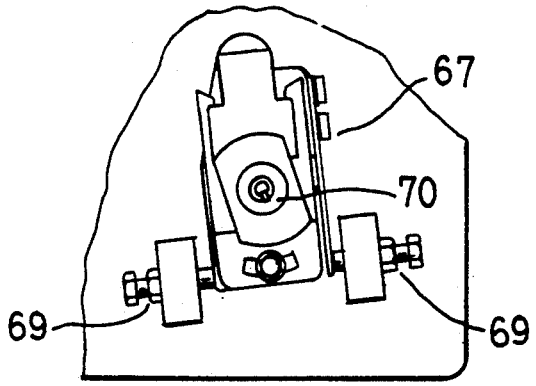
FIG. 7 shows a diagrammatic representation of the adjusting mechanism for the pressure-spring force of the pressure roller.
Figure 6:
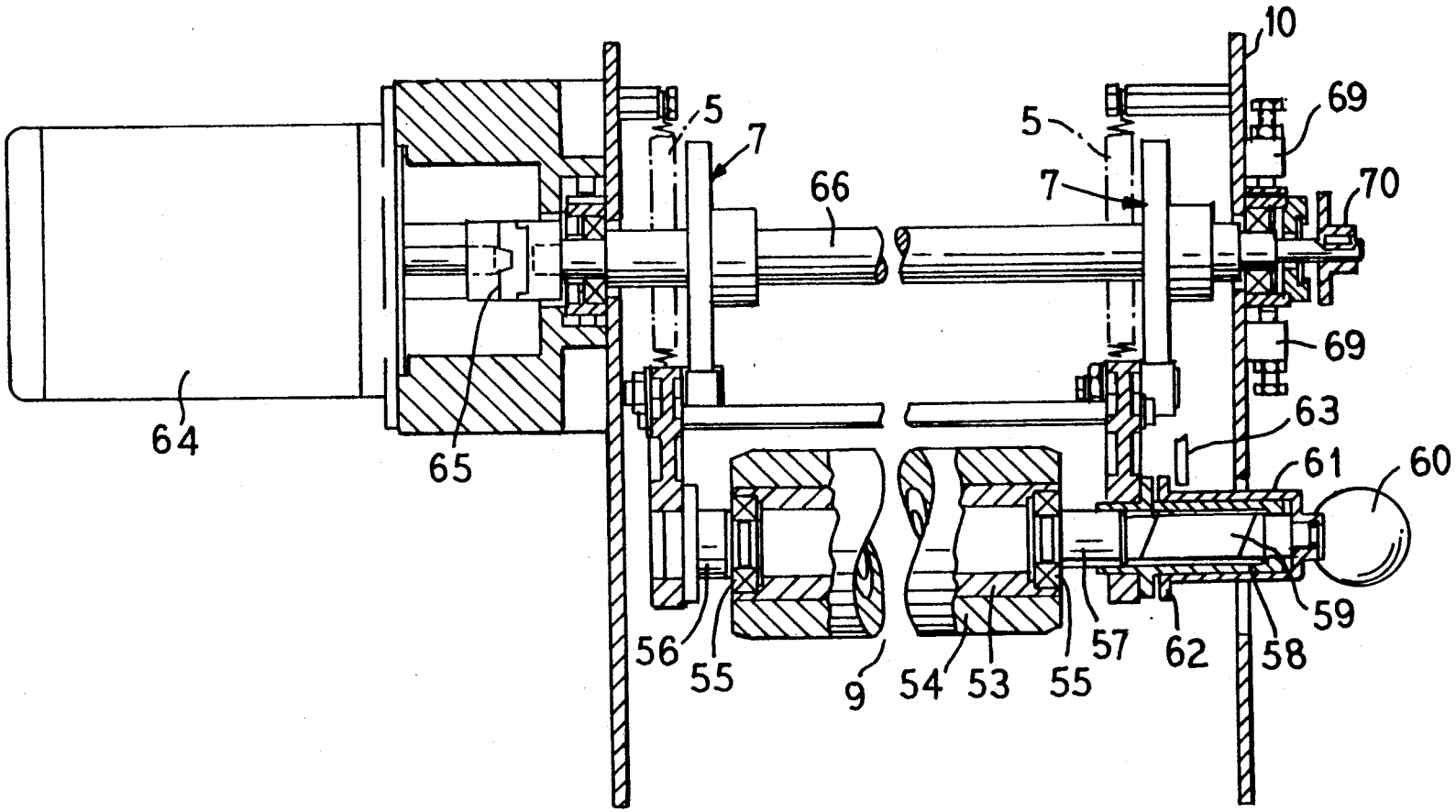
FIG. 6 shows a diagrammatic sectional representation of the drive of the pressure roller in a top view according to FIG. 5.

If the pressure roller 9 is to be exchanged in the swung-away state of the fixing roller 11, according to the representation of FIG. 8 the lock between the movable receiving bolt 57 and the pressure roller 9 is released by pulling on the operating knob 60. The pressure roller can then be extracted from the fixing station from below, preferably with protective gloves. Protective gloves 50 are necessary when an exchange of the pressure roller 9, together with the heating-roller exchange, is to be carried out in the hot state of the fixing station.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A fixing station for an electrophotographic printing or copying apparatus, comprising: an electrically heated fixing roller and a pressure roller swingable up to and away from the fixing roller via fastening mechanism, the fixing roller being a hollow roller having heating elements arranged therein and being mounted in a stand of the fixing station via first and second bearing flanges, the first bearing flange being fixed to the stand and the second bearing flange being releasably attached to the stand; and holding elements that, for extraction of the fixing roller from the fixing station, connect the second bearing flange to the fixing roller and allow a separation of the second bearing flange from the fixing roller after extraction, only said second bearing flange of said first and second bearing flanges having a handle element, said second bearing flange being a holding and removal element for said fixing roller such that both said second bearing flange and said fixing roller are completely separable from said stand.

2. The fixing station as claimed in claim 1, wherein the first and second bearing flanges have centering elements which engage laterally into the fixing roller and on which the foxing roller rests slidably, and wherein spring elements are arranged on at least one of the first and second bearing flanges spring elements for compensating for thermal axial movement of the fixing roller and which clamp the fixing roller between the first and second bearing flanges.

3. The fixing station as claimed in claim 1, wherein heat-insulating elements are arranged in the fixing roller, the heat-insulating elements screening off the first and second bearing flanges relative to a region heated by the heating elements.

4. The fixing station as claimed in claim 1, wherein the first and second bearing flanges have respective central receiving orifices for exchangeable reception of heating elements combined to form a radiator module, the central receiving orifices arranged such that the radiator module can be exchanged without removal of the fixing roller.

5. The fixing station as claimed in claim 4, wherein the radiator module has at one end thereof a reception region for receiving a thermally insulating gripping piece.

6. The fixing station as claimed in claim 1, wherein the pressure roller is mounted releasably between two rockers swingable up to and away from the fixing roller about an axle iva an electromotively driven eccentric device.

7. The fixing station as claimed in claim 6, wherein the eccentric device has a camshaft with cam disks arranged thereon, the camshaft being variable via an adjusting mechanism in terms of its location relative to the rockers to be actuated.

8. The fixing station as claimed in claim 1, wherein the fixing station further comprises a cooling shelf for at least one of the fixing roller and the heating element, the cooling shelf being attached to said stand.

9. A fixing station for an electrophotographic printing or copying apparatus, comprising: an electrically heated fixing roller and a pressure roller swingable up to and away from the fixing roller via a fastening mechanism, the fixing roller being a hollow roller having heating elements arranged therein and being mounted in a stand of the fixing station via first and second bearing flanges, the first bearing flange being fixed to the stand and the second bearing flange being releasably attached to the stand; and holding elements that, for extraction of the fixing roller from the fixing station, connect the second bearing flange to the fixing roller and allow a separation of the second bearing flange from the fixing roller after extraction, the pressure roller being moutend releasably via a fixed bolt and a moveable bolt that is movable counter to a spring, the movable bolt having an operating knob.

10. The fixing station as claimed in claim 9, wherein the second bearing flange has a handle element.

11. The fixing station as claimed in claim 9, wherein the first and second bearing flanges have centering element which engage laterally into the fixing roller and on which the fixing roller rests slidably, and wherein spring elements are arranged on at least one of the first and second bearing flanges for compensating for thermal axial movement of the fixing roller and which clamp the fixing roller between the first and second bearing flanges.

12. The fixing station as claimed in claim 9, wherein heat-insulating elements are arranged in the fixing roller, the heat-insulating elements screenign off the first and second bearing flanges relative to a region heated by the heating elements.

13. The fixing station as claimed in claim 9, wherein the first and second bearing flanges have respective central receiving orifices for exchangeable reception of heating elements combined to form a radiator module, the central receiving orifices arrange such that the radiator module can be exchanged without removal of the fixing roller.

14. The fixing station as claimed in claim 13, wherein the radiator module has at one end thereof a reception region for receiving a thermally insulating gripping piece.

15. The fixing station as claimed in claim 9, wherein the pressure roller is mounted releasably between two rockers swingable up to and away from the fixing roller about an axle via an electromotively driven eccentric device.

16. The fixing station as claimed in claim 15, wherein the eccentric device has a camshaft with cam disks arranged thereon, the camshaft being variable via an adjusting mechanism in terms of its location relative to the rockers to be actuated.

17. The fixing station as claimed in claim 9, wherein the fixing station further comprises a cooling shelf for at least one of the fixing roller and the heating element, the cooling shelf being attached to said stand.

* * * * *